US005322033A

United States Patent [19]

Doan

[11] Patent Number: 5,322,033

[45] Date of Patent: Jun. 21, 1994

[54] MECHANISM FOR INDICATING WHEN TO CHANGE ENGINE OIL

[76] Inventor: Duc T. Doan, 7814 S. San Pedro, Los Angeles, Calif. 90003

[21] Appl. No.: 927,324

[22] Filed: Aug. 10, 1992

[51] Int. Cl.[5] ..... G04F 8/00

[52] U.S. Cl. ..... 116/308; 180/279; 368/5

[58] Field of Search ..... 340/457.4, 450.3; 368/82, 107, 5, 8, 6, 10, 9; 33/722; 180/272, 279

[56] References Cited

U.S. PATENT DOCUMENTS

| | | | |
|---|---|---|---|
| 2,435,907 | 2/1948 | Schirokauer | 340/457.4 |
| 3,299,627 | 1/1967 | Hart et al. | 368/5 X |
| 4,022,014 | 5/1977 | Lowdenslager | 368/10 X |
| 4,287,585 | 9/1981 | Numabe | 368/107 X |
| 4,381,042 | 4/1983 | Perry | 180/272 |
| 4,476,714 | 10/1984 | Barry et al. | 340/450.3 X |
| 4,551,703 | 11/1985 | Bourauel et al. | 340/457.4 |
| 4,630,292 | 12/1986 | Juricich et al. | 368/8 X |
| 4,654,646 | 3/1987 | Charboneau | 340/450.3 X |
| 4,742,476 | 5/1988 | Schwartz et al. | 340/457.4 X |
| 4,876,529 | 10/1989 | Kubota et al. | 340/450.3 |
| 4,912,687 | 3/1990 | Treeby | 368/107 X |
| 5,043,697 | 8/1991 | Ayabe et al. | 340/438 X |

*Primary Examiner*—Daniel M. Yasich
*Attorney, Agent, or Firm*—Hawes & Fischer

[57] ABSTRACT

A mechanism for measuring the running time of an internal combustion engine includes a numerical display of the engine running hours, such that the owner of the engine can better determine the appropriate time for changing the engine lubrication oil. A chronometer is controlled by a switch responding sensitively to engine temperature or vibration, so that the chronometer is actuated only while the engine is working. The mechanism is incorporated into the handle of an oil dipstick, which enables the engine owner to check the chronometer at the same time as he/she is checking the engine oil level.

18 Claims, 1 Drawing Sheet

MECHANISM FOR INDICATING WHEN TO CHANGE ENGINE OIL

BACKGROUND OF THE INVENTION

1. Field of the Invention

This invention relates to combustion engines, and particularly to a mechanism mountable on an engine for indicating when it is necessary to change the engine lubrication oil. The invention is applicable to various engines, including gas or diesel engines used in automobiles trucks, motor cycles and electric generators.

2. Prior Developments

Combustion engine life can be prolonged by periodically changing the engine lubrication oil. In many engine installations there is no convenient mechanism for knowing when to change the oil. In the case of automotive engines, usually the frequency between oil changes is measured in miles driven, e.g. five thousand miles in a typical situation. This system requires that the owner maintain a record of the odometer reading at a given oil change in order that he/she will know when to make next oil change. However, it is possible for the owner to misplace the record or otherwise forget the mileage at the last oil change. If the oil is inadvertently not changed at the desired frequency (e.g. every five thousand miles) the engine may tend to wear out prematurely.

Another problem associated with using the vehicle odometer reading as an indicator for the next anticipated oil change is the fact that the odometer reading may not accurately reflect the actual engine running time. For example, if the automotive vehicle is run primarily in urban areas the engine may be running at idle much of the time, e.g. when the vehicle is moving in stop-and-go traffic; in this case the odometer reading may be misleading. Also, if the driver tends to warm-up the engine for long periods of time prior to highway driving, the odometer reading will not fully reflect the engine running time. On the other hand, if most of the driving is done on super highways at elevated speeds the transmission may be in overdrive, in which case the odometer reading may give an excessively high indication of engine running time, or the odometer is not functioning, which frequently occurs in old cars.

SUMMARY OF THE INVENTION

This invention relates to a mechanism for recording engine running time, such that the engine owner has a better indication of the appropriate time for the next oil change. The mechanism comprises an electrically-energized hour chronometer, and an electrical power supply for energizing the chronometer essentially only when the engine is running. Current flow from the power supply to the chronometer is controlled by a temperature or vibration sensitive means responsive to engine temperature, or engine vibrations, whereby the chronometer is energized essentially only when the engine is running.

In preferred practice of the invention the chronometer is incorporated into the handle of the engine oil dipstick. With such a location the owner of the engine is reminded of the possible need for changing or adding oil whenever he/she is manipulating the dipstick to read the oil level. The physical construction is designed to provide the engine owner with a mental linkage between the companion requirements of maintaining a proper oil level and the time changing or adding of the oil. However, the mechanism could be mounted any place under the hood or cover of the engine.

THE DRAWINGS

DESCRIPTION OF A PREFERRED EMBODIMENT OF THE INVENTION

Figure 1:
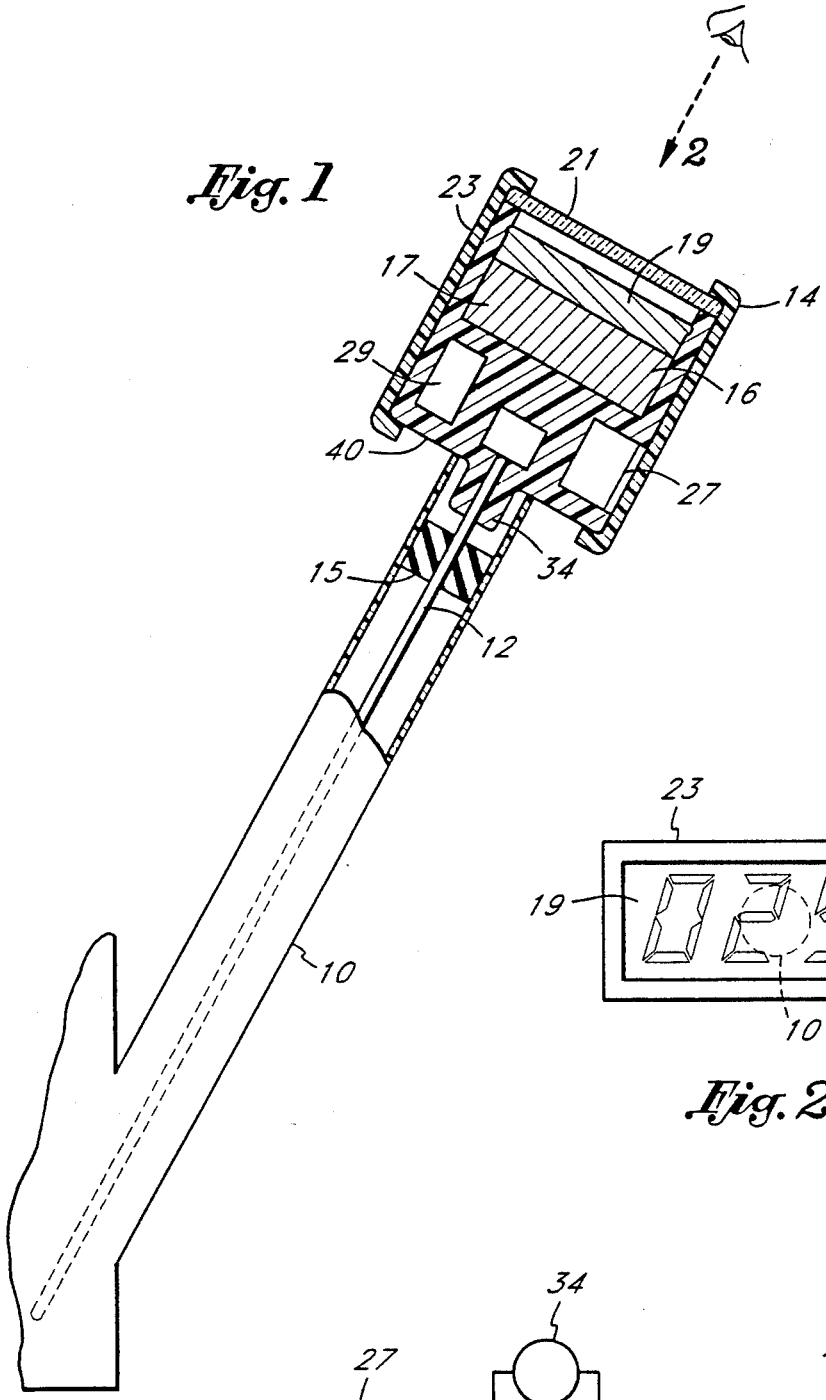
FIG. 1 is a view, partly in section, of a mechanism embodying the invention.

There is shown in FIG. 1 an upstanding oil tube 10 commonly used in internal combustion engines for indicating the engine lubrication oil level. The lower end of tube 10 communicates with the engine crankcase. An oil dipstick 12 is attached to a handle 14 for insertion into tube 10. An annular rubber ring 15 is carried by dipstick 12 for centering the dipstick in tube 10. The lower end portion of dipstick 12 will extend into the oil in the crankcase so that an oil film will adhere to the dipstick when handle 14 is pulled upwardly to withdraw the dipstick out of oil tube 10; the engine owner can visually measure the oil film demarcation against markings on the dipstick in order to determine the level of oil and thus whether it is necessary to change the oil in or add new oil to the crankcase.

The illustrated handle comprises a housing 40 formed of a molded plastic material that serves to mount an electrically-energizable hour chronometer 16 therein. The chronometer is a commercially available construction that includes a digital clock 17 and a liquid crystal display 19 electrically connected to the clock output. A sighting window 21 is held in place above the liquid crystal display by means of annular rectangular frame 23.

Figure 2:
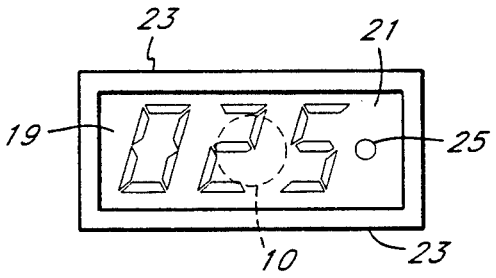
FIG. 2 is a top plan view of a part of the FIG. 1 mechanism, taken in the direction of arrow 2 in FIG. 1.

As shown in FIG. 2, the liquid crystal display comprises three sets of seven-segment bars that can be selectively darkened to produce three separate digits. FIG. 2 shows the digits as forming the number "025", which represents twenty five hours engine running time. The three digit number can vary from a low "000" to a maximum "999", depending on the number of elapsed engine running hours measured from a preselected start time setting of "000". A manually-depressible reset button 25 extends from digital clock 17 through a hole in window 21, whereby the driver or owner of the engine can depress the button to reset the liquid crystal display to the "000" setting. This would normally happen at the time that the engine oil is changed.

With the liquid crystal display at the "000" setting, subsequent engine running time causes the digits to correspondingly change, such that the engine owner has a continuing record on which to base the need for the next oil change.

In the case of automotive engines, there is no absolute ratio between miles driven and engine running hours. However the ratio is roughly about fifty to one. Thus, one hundred engine running hours corresponds to about 5000 miles on the vehicle odometer; sixty engine running hours corresponds to about 3000 miles on the odometer, etc.

In use of the chronometer the engine owner would normally decide how frequently he/she wished to change the oil, based largely on manufacturer recommendation. The owner would do so when the appropriate number appeared on the liquid crystal display. In the case of an automotive engine, it would not be necessary for the owner to refer to the vehicle odometer or to make any subtractions of odometer readings in order to make the determination as to the appropriate time for the oil change.

An advantage of the illustrated arrangement is that the digital display is visible to the engine owner whenever he/she checks the oil level. The owner is thus in a position to make two determinations at one time, i.e. whether to add new oil and/or whether to change the oil. In some cases he/she might elect to change the oil rather than adding oil (e.g. if the engine run hours reading is near the value established by the owner as the appropriate time for the next oil change).

Figure 3:
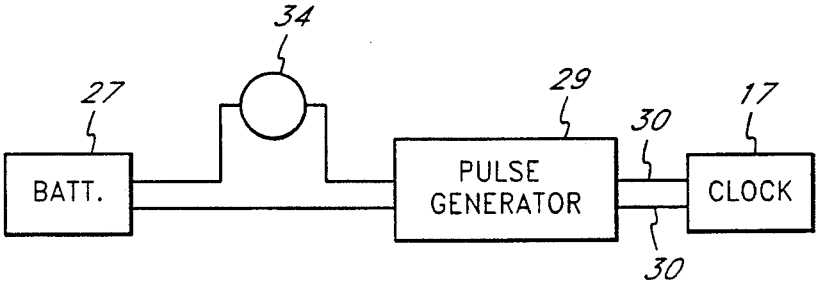
FIG. 3 is an electric circuit diagram for the FIG. 1 mechanism.

The chronometer may be powered from a dry cell battery 27 located in handle 14. A pulse generator 29 is operated by the battery to deliver timed pulses to the digital clock 17. A switch means 34, e.g. a thermal, bi-metal switch or a vibration sensitive switch in circuit with the battery and the pulse generator such that pulses are generated only when the said switch means is in a working condition. Thus when the ambient temperature is relatively low, the switch means 34, e.g. the thermal or bi-metal switch remains open and thus prevents the generation of pulses. When the engine heat reaches an elevated temperature, the switch means closes to pass the pulses through lines 30 (FIG. 3).

If the switch means, e.g. is a vibration sensitive switch, the latter will only close when the engine is running and creating vibrations.

Switch means 34 is located on the engine at a point where it will be exposed to heat or vibrations, when the engine is working. As shown, the switch means encapsulated in a plastic collar that extends from a plastic housing 40 used to contain battery 27 and pulse generator 29. The switch means in contact with the side surface of dipstick 12 so that it responds to temperature changes or vibrations on the dipstick surface.

The dipstick extends downwardly into the engine lubrication oil in the engine crankcase, such that when the engine is running the heated oil in the crankcase heats the dipstick to an elevated temperature. The switch means selected is then e.g. a bi-metal switch, and is responsive to the engine temperature. When a vibration switch means is applied, the vibrations of the engine will control the current pulse flow to the chronometer. In either case the chronometer is energized essentially only while the engine is running.

There may be a slight or insignificant time delay at engine start-up when a heat responding switch is selected, to respond to engine heat sufficiently heated as to close and cause the pulses to pass through the lines. However, there is a corresponding time delay at engine shut down when the switch means briefly remains closed and pulses are still passing through while the engine oil is cooling down. The time delays tend to compensate for each other so that the switch means conducting period is numerically the same as the engine running period.

The electrical connections between the battery switch means, 34, pulse generator 29, and electronic digital clock 17 can be accomplished in various ways. FIG. 1 schematically shows one way that the components can be arranged within the metal frame 23. Other arrangements can be used to operatively position the various components in the dipstick handle 14.

The illustrated device is a self-contained unit that can be installed on existing engines without modifying the engine or adding additional mounting componentry. The pre-existing oil tube 10 can be used to mount the handle-dipstick unit.

As previously noted, the invention can be utilized in various different engines, e.g. automotive power plants or stationary engine power plants.

The drawings show one form of the invention. However, it will be appreciated that the invention can be practiced in various forms and configurations.

I claim:

1. In an internal combustion engine having an oil lubrication system: a mechanism for indicating engine running time from one oil change to the next anticipated oil change; said mechanism comprising an oil dipstick adapted for insertion into an upstanding oil tube that extends from the engine crankcase; a handle attached to said dipstick for manual manipulation thereof; an electrically energized hour chronometer incorporated into said handle so as to be readable when the dipstick is fully inserted into the oil tube; an electrical power supply for said chronometer tube; an electrical power supply for said chronometer mounted within said handle; and sensitive means connected to said chronometer for controlling current flow from the power supply to the chronometer responsive to forces released by the engine when running whereby the chronometer is energized essentially only when the engine is working.

2. The mechanism of claim 1, wherein said sensitive means is a thermal switch, responding to elevated temperatures of engine heat.

3. The mechanism of claim 1, wherein said sensitive means is a bi-metal switch responding to elevated temperatures of engine heat.

4. The mechanism of claim 1, wherein said switch means is a vibration sensitive switch responding to vibrations of the engine when running.

5. The mechanism of claim 1, wherein said hour chronometer comprises a digital clock having a liquid crystal display; said liquid crystal display facing upwardly when the dipstick is fully inserted into the oil tube.

6. A combustion engine, with an oil lubrication system, having a mechanism for indicating engine running time from an oil change to the next anticipated oil change, comprising:

An electrically energized chronometer mounted adjacent to the engine; an electric power supply system for said chronometer mounted adjacent thereto; a sensitive means incorporated therein responsive to forces released by the engine when working in order to control the current flow from the power supply to said chronometer, whereby said chronometer is energized essentially only when the engine is working.

7. The mechanism of claim 5, wherein said hour chronometer comprises a digital clock having a liquid crystal display.

8. A mechanism for indicating engine running time comprising:

a housing mountable near an engine;

a chronometer supported by said housing;

sensor means, connected to said chronometer, for selectively energizing said chronometer in response to thermal energy released by the internal combustion engine when running whereby the chronometer is energized essentially only when said internal combustion engine is running.

9. The mechanism of claim 8 wherein said mechanism further comprises means for facilitating attachment to an oil dipstick.

10. The mechanism of claim 8 wherein said mechanism further comprises a housing supporting said chronometer and means for energizing said chronometer.

11. The mechanism of claim 10 wherein said mechanism further comprises attachment means, supported by said housing, for facilitating attachment to an oil dipstick.

12. The mechanism of claim 8 wherein said means for energizing said chronometer further comprises:

a battery;

a vibration switch electrically connected to said battery and said chronometer which powers said chronometer when receiving vibrations from the running of said engine.

13. The mechanism of claim 8 wherein said means for energizing said chronometer further comprises:

a battery;

a thermal switch electrically connected to said battery and said chronometer which powers said chronometer when receiving heat due to the running of said engine.

14. The mechanism of claim 8 wherein said means for energizing said chronometer further comprises:

a battery;

a bi-metal switch electrically connected to said battery and said chronometer which powers said chronometer when receiving heat due to the running of said engine.

15. A process of monitoring the running time of a vehicle engine to determine the need for an oil change comprising the steps of:

placing a timing device for recording the time during which forces are released by a vehicle's engine, in proximity to said engine, as an indication of the amount of time said engine has been running;

running said engine to release forces from said engine into said timing device for recording; and checking said timing device for recording to determine the amount of time said engine has been running.

16. The process of monitoring the running time of a vehicle as recited in claim 15 and further comprising the step of re-setting the chronological time of said timing device for recording when said engine's oil is changed.

17. The process of monitoring the running time of a vehicle as recited in claim 15 wherein said placing a timing device step is accomplished by inserting an oil dipstick containing said timing device into said engine.

18. The process of monitoring the running time of a vehicle as recited in claim 17 and further comprising the step of attaching said timing device to an oil dipstick before inserting said oil dipstick containing said timing device into said engine.

* * * * *